US006749710B2

(12) United States Patent
Preston et al.

(10) Patent No.: US 6,749,710 B2
(45) Date of Patent: Jun. 15, 2004

(54) COMBINATION STATIC CLING AND PRODUCT LABEL ASSEMBLY

(75) Inventors: Robin R. Preston, Comstock Park, MI (US); John L. Jonkman, Lowell, MI (US)

(73) Assignee: Grand Rapids Label Company, Grand Rapids, MI (US)

( * ) Notice: Subject to any disclaimer, the term of this patent is extended or adjusted under 35 U.S.C. 154(b) by 28 days.

(21) Appl. No.: 10/064,361

(22) Filed: Jul. 5, 2002

(65) Prior Publication Data

US 2002/0153091 A1 Oct. 24, 2002

Related U.S. Application Data

(62) Division of application No. 09/536,670, filed on Mar. 27, 2000, now Pat. No. 6,416,835.
(60) Provisional application No. 60/131,931, filed on Apr. 30, 1999.

(51) Int. Cl.[7] ..... B44C 1/165

(52) U.S. Cl. ..... 156/230; 156/237; 156/239; 156/269; 156/277; 156/386; 156/287; 156/510; 283/81

(58) Field of Search ..... 156/230, 237, 156/239, 269, 277, 386, 387, 510, 235, 241, 256, 264, 265, 314; 283/81; 428/40.1, 41.8, 42.1

(56) References Cited

U.S. PATENT DOCUMENTS

| | | | | | |
|---|---|---|---|---|---|
| 4,400,419 | A | | 8/1983 | Laczynski | |
| 4,652,239 | A | | 3/1987 | Brimberg | |
| 5,102,171 | A | * | 4/1992 | Saetre | 283/117 |
| 5,174,605 | A | | 12/1992 | Instance | |
| 5,334,431 | A | | 8/1994 | Longtin | |
| 5,352,155 | A | * | 10/1994 | Fahey | 462/25 |
| 5,403,025 | A | | 4/1995 | Shanley | |
| 5,620,764 | A | | 4/1997 | Schwarz et al. | |
| 5,643,388 | A | | 7/1997 | Peterson | |
| 5,738,748 | A | * | 4/1998 | Mitchell, Jr. | 156/253 |
| 5,888,615 | A | | 3/1999 | Mascarenhas et al. | |

* cited by examiner

*Primary Examiner*—Richard Crispino
*Assistant Examiner*—Michelle Acevedo Lazor
(74) *Attorney, Agent, or Firm*—McGarry Bair PC

(57) ABSTRACT

A method of making the label assembly comprises providing a label stock material having a printed upper surface and a lower surface adhesively secured to a backing web having a release coating; laminating a web of static cling material is to the upper surface of the label stock material, printing on the upper surface of the static cling web material; and die cutting the label stock/static cling web material into discrete label assemblies. A method for servicing an automobile with a label assembly that has a pressure sensitive product label with printed product or service indicia and a static cling layer with data entry indicia mounted on the product label includes the steps of applying the label assembly to a service portion of the vehicle, applying oil change data to the static cling layer and applying the static cling layer to the windshield of the automobile.

12 Claims, 4 Drawing Sheets

COMBINATION STATIC CLING AND PRODUCT LABEL ASSEMBLY

CROSS REFERENCE TO RELATED APPLICATIONS

This application is a divisional of U.S. Patent application Ser. No. 09/536,670, filed Mar. 27, 2000, now U.S. Pat. No. 6,416,835, issued Jul. 9, 2002, which claims the benefit of provisional patent application Serial No. 60/131,931, filed Apr. 30, 1999.

BACKGROUND OF INVENTION

1. Field of the Invention

This invention relates to label assemblies and methods of making the same. In one of its aspects, the invention relates to a method of making a label assembly. In still another of its aspects, the invention relates to a method for servicing an automobile with a windshield in which the oil is changed and a static cling layer is applied to a windshield with date/mileage sensitive information recorded.

2. Description of Related Art

Static cling labels are used as reminders to a vehicle owner for oil change purposes. The static cling labels cling to the inside surface of an automobile windshield and have written information as to when the next oil change is due in terms of mileage and/or date. These static cling labels are applied at the time of an oil change.

Similar types of information are placed on the inside of a door of the vehicle or, alternatively, on an oil filter canister. The oil filter canister will have a product label indicating the type of filter that is installed in the filter canister. These labels typically have a slip agent or anti-blocking agent incorporated in an external varnish which covers the printed label to prevent marring of the label prior to installation of the label on the product. These slip agents and anti-blocking agents make the surface fairly slippery and avoid surface abrasions due to inadvertent rubbing of the surface with hard parts. These varnishes provide a slippery surface for laminates as well and typically do not hold laminates that do not have adhesives on them.

The U.S. Patent to Longtin, issued Aug. 2, 1994, discloses an assembly of a web substrate and a plurality of release liners having static cling labels thereon for dispensing the static cling labels. The release liner is described as a polycoated bleached liner or a white tag liner. The release liner is said to be discarded after the static cling layer has been applied to an intended surface. The polycoated bleached liner and white tag liner are usually coated with a slip agent or anti-blocking agent to form a slippery surface which does not hold the static cling layer well.

Shanley U.S. Pat. No. 5,403,025 ("Shanley '025 patent") discloses a partially preprinted, service invoice record form having a piggyback vinyl static cling customer service information label. The forms have preprinted information and have positioned thereon a static cling label that is carried on a polyester carrier layer that has an adhesive coating on a back surface thereof. There is no printing on the front surface of the Shanley '025 polyester label. Shanley '025 patent further discloses a process for making the labels for the preprinted forms. The labels are made from a three-ply roll of materials in which a bottom layer has a release coating, a polyester layer has a pressure sensitive adhesive on an underside thereof and a static cling layer is adhered to an upper surface of the polyester layer. The three-ply stock is fed through a printer and die cutter to print relevant information on areas of the static cling layer in the printer and the static cling layer and the polyester layer are die cut to form the individual label assemblies. The salvage is removed from the web to leave a carrier web with individual label assemblies having printing in three separate areas on the static cling layer. The label assemblies are then peeled from the web and then pasted on a paper form. The form is then printed with customer information and a previously unprinted area is also printed with customer information. The entire static cling label is removed and placed on a windshield of car with information. The remaining polyester carried on the form 58 is blank. There is no printing on the polyester carrier. Nor could there be any printing on the polyester label because the polyester layer remains in contact with the static cling later during the entire process of making the Shanley '025 label assembly.

SUMMARY OF INVENTION

According to the invention, a method of making a label assembly comprises providing a label stock material having a printable upper surface and a lower surface adhesively secured to a backing layer with a release coating. The label stock material is printed with product or service information on an upper surface. Preferably, the upper surface of the label stock material is coated with a raw varnish without any slip agent or anti-blocking agent. A web of static cling material is laminated to the printed upper surface of the label stock material and an upper surface of the static cling web is printed. The static cling and paper stock webs are die cut to form labels and the excess label stock and static cling label are removed from the backing layer. The backing layer with the adhesive laminate is rolled into a roll of stock material.

Still further according to the invention, a method for servicing an automobile with a windshield, in which the oil is changed and a static cling layer is applied to a windshield with date/mileage sensitive information recorded, comprises the steps of providing a label assembly including a product label having on one side a pressure sensitive adhesive and on another side product or service indicia printed thereon. A static cling layer is releasably mounted on the other side of the product label over the indicia. The static cling layer has printed recording indicia on one side thereof. The label assembly is applied to one portion of the vehicle visible to a service person, for example, a filter canister or a door frame. Information, for example, mileage and date, is applied to the static cling layer. The static cling layer is then applied to the windshield of the automobile.

In one embodiment of the above method, the product label has indicia indicative of an oil filter and the static cling label has indicia for entry of mileage and date of filter change information. In a preferred embodiment of the above method, the other side of the product label has a raw varnish finish to enhance adhesion of the static cling label to the other side of the product label. The raw varnish coating has essentially no slip agent or anti-blocking agents incorporated therein.

DETAILED DESCRIPTION

Figure 1:
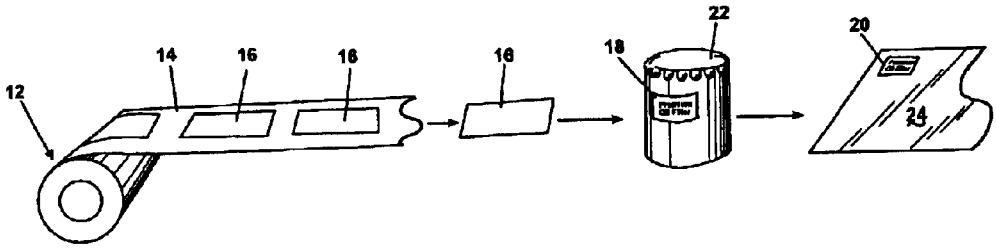
FIG. 1 is a perspective schematic view of a label assembly according to the invention and the manner in which the label assembly is used.

Referring now to the drawings and to FIG. 1 in particular, a roll of labels 12 comprises a backing web 14 and a label assembly 16 according to the invention. The label assembly 16 is releasably mounted to the backing layer 14 through a pressure-sensitive adhesive. The label assembly 16 can be peeled from the backing layer 14 in a conventional manner and applied to a support surface, for example, a filter canister. The label assemblies 16 comprise a product label 18 with printing on an upper surface thereof and a printed static cling label 20. Indicia is typically written onto the printed static cling label by a worker at the time the label assembly 16 is peeled from the backing web 14 and applied to the filter canister 22. The static cling label 20 is then removed from the printed product label 18 and applied to a more visible surface, for example, the inside surface of a windshield 24.

Figure 2:
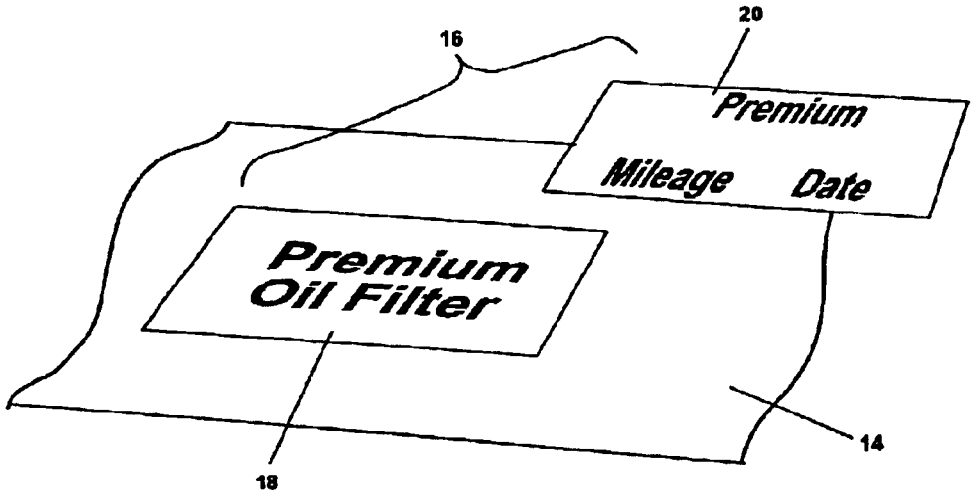
FIG. 2 is a perspective exploded view of a label assembly according to the invention.

With reference to FIG. 2, the label assembly comprises a backing sheet 14, a printed product label 18 and a printed static cling label 20 which are assembled as a unit. The product label 18 is mounted to the backing layer through a conventional pressure-sensitive adhesive. The backing layer 14 is a conventional release layer having a release coating. The static cling label 20 is of conventional construction and has printing thereon.

Figure 3:
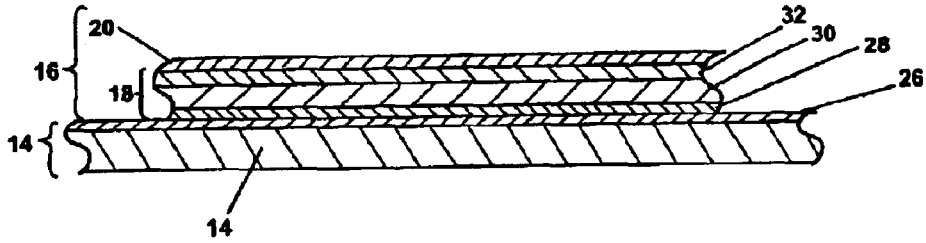
FIG. 3 is a cross-sectional view through a label assembly according to the invention as mounted on a backing layer with a release coating.

The structure of the label assembly 16 is illustrated in cross section in FIG. 3 to which reference is now made. The backing layer 14 has a release coating 26 on an upper surface. A base stock material 30 has a pressure-sensitive adhesive 28 on an underside thereof. The base stock material 30 can be paper or plastic film. The adhesive releasably mounts the stock material 30 to the backing web 14. The stock material 30 has printing (not shown in FIG. 3) on an upper surface thereof and has a varnish coating 32 over the printing label. The varnish coating is desirably a raw polymer varnish without slip agent or anti-blocking agents such as polyethylene and waxes. Examples of such varnishes are XCELL WVF 010910 manufactured by Water Ink Technology of North Carolina or a UV varnish from North West Coatings Corporation, designated as NORTH WEST 12517. Another example of such coating in K-2072 from SUN Chemical of Kalamazoo, Mich.

The stock material 30, the adhesive 28 and the varnish coating 32 form the product label 18. A static cling label 20 is mounted on the varnish coating 32 and is adhered thereto simply by static cling forces. The static cling label 20 and the product label 18 form the label assembly 16.

Static cling labels are well known and comprise soft vinyls which cling to surfaces like Saran Wrap®. An example of a static cling label web is made by Flexcon of Spencer, Mass. Other examples of a static cling label webs include static cling polyolefins and face stocks (paper or plastic film) with ultra low peel adhesives. Another static cling material which can be used in the invention is statically charged polypropylene film under the trade Cling Z manufactured by Permacharge and distributed by Transilwrap.

Figure 4:
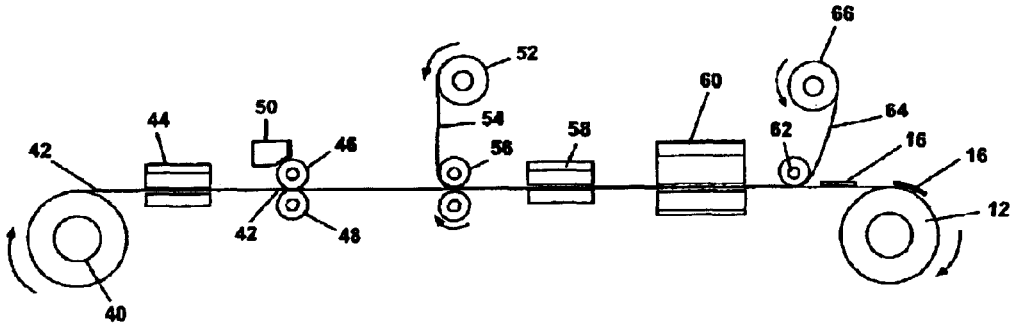
FIG. 4 is a schematic view of a process for making the label assembly according to the invention.

A process for making the label assembly according to the invention is illustrated in FIG. 4 to which reference is now made. A roll 40 of label stock material 42 comprises a laminate of a conventional label web 28, 30 which is adhesively laminated to a backing web 14 having a release coating 26 thereon. The upper surface of the label stock material 42 is passed through a printer 44 wherein printed material is coated onto the upper surface of the label stock material 42. The label stock material 42 is then passed through a varnish applicator comprising an idler roll 48, a varnish application roller 46 which applies varnish from a varnish vat 50 in a well-known manner. The varnish applied is the raw polymer varnish without a slip agent or an anti-blocking agent. If desirable, minor amounts of slip agent or an anti-blocking agent can been added to the raw polymer varnish. The varnish layer is dried, for example, in a conventional dryer or by air drying, and a static cling web 54 which is fed from a roll of static cling material 52 is laminated to the varnish layer on the label stock material 42 with the aid of idle rollers 56. The laminated static cling material and paper stock is then passed through a printer 58 wherein a print coating is added to the upper surface of the static cling web. The laminated and printed assembly is then passed through a die cutter 60 wherein labels are die cut in a conventional fashion. A salvage web 64 is peeled from the labels on the backing web 14 at an idle roller 62 and is collected in a roll 66. The remaining laminate comprises the backing web 14 and label assemblies 16 which are then collected in a roll of labels 12.

Whereas the invention has been described with reference to a combination reminder static cling label and product label for use in oil filters and with oil changes, the label assemblies can be used for many different purposes. The labels can be used for any purpose in which a product label is applied to a container and a reminder label is placed on another surface which can remind a consumer of some event in the future. Thus, the invention is not limited to the specific application of an oil filter and oil change reminder.

Reasonable variation and modification are possible within the scope of the foregoing disclosure and drawings without departing from the spirit of the invention.

What is claimed is:

1. A method of making a label assembly from a indefinite length of label stock material comprising a backing web having a release coating on a surface thereof and a label web which is adhesively laminated to the release-coated surface of the backing web by a pressure sensitive adhesive on a lower surface of the label web, the label web having an upper surface, the method comprising the steps of:

printing product indicia onto the label web upper surface;

releasably applying a static cling layer having static charge to the printed upper surface of the label web;

and die-cutting the label web and the static cling layer into discrete label assemblies.

2. The method of claim 1, and further comprising applying a raw varnish coating to the upper surface of the label web after the printing step.

3. The method of claim 2, and further comprising printing data entry indicia on the static cling layer in registry with the product indicia on the printed upper surface of the label web.

4. The method of claim 1, and further comprising printing data entry indicia on the static cling layer in registry with the product indicia on the printed upper surface of the label web.

5. A method of making a label assembly from an indefinite length of label stock material comprising a backing web having a release coating on a surface thereof and a label web which is adhesively laminated to the release-coated surface of the backing web by a pressure sensitive adhesive on a lower surface of the label web, the label web having an upper surface, the method comprising:

applying a raw varnish coating onto the label web upper surface;

releasably applying a static cling layer having static charge to the upper surface of the label web; and die-cutting the label web and the static cling layer into discrete label assemblies.

6. A method for servicing an automobile with a windshield in which the oil is changed and a static cling layer is applied to a windshield with date/mileage sensitive information recorded, comprising the steps of providing a label assembly comprising a product label having on one side a pressure sensitive adhesive and on another side at least one of product and service indicia printed thereon a static cling layer having static charge releasably mounted on the other side of the product label over the indicia, the static cling layer having data entry indicia on one side thereof, applying the label assembly to one portion of the vehicle visible to a service person;

applying oil change data to the static cling layer; and applying the static cling layer to the windshield of the automobile.

7. The method of claim 6 wherein the product label has indicia indicative of an oil filter and the static cling label has indicia for entry of mileage and date of filter change information.

8. The method of claim 6 wherein the other aide of the product label has a raw varnish finish to enhance adhesion of the static cling label to the other side of the product label.

9. The method of claim 8 wherein the product label has indicia indicative of an oil filter and the static cling label has indicia for entry of mileage and date of filter change information.

10. The method of claim 9 wherein the raw varnish coating has essentially no slip agent or anti-blocking agents incorporated therein.

11. The method of claim 8 wherein the raw varnish coating has essentially no slip agent or anti-blocking agents incorporated therein.

12. The method of claim 6 wherein the one portion of the vehicle is the oil filter canister.

* * * * *